US010358850B1

(12) United States Patent
McIntire et al.

(10) Patent No.: US 10,358,850 B1
(45) Date of Patent: Jul. 23, 2019

(54) INWARD SWINGING DOOR BARRICADE

(71) Applicant: The United States of America as represented by the Secretary of the Air Force, Washington, DC (US)

(72) Inventors: John P. McIntire, Dayton, OH (US); Jonathan D. Boston, Fairborn, OH (US); Matthew Srnoyachki, Beavercreek, OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 385 days.

(21) Appl. No.: 15/097,371

(22) Filed: Apr. 13, 2016

Related U.S. Application Data

(60) Provisional application No. 62/181,432, filed on Jun. 18, 2015.

(51) Int. Cl.
*E05C 19/18* (2006.01)
*E05B 17/20* (2006.01)

(52) U.S. Cl.
CPC ..... *E05C 19/182* (2013.01); *E05B 17/2084* (2013.01)

(58) Field of Classification Search
CPC ..... E05C 19/182; E05C 19/00; E05C 19/001; E05C 19/184; E05C 17/54; E05B 17/2084; E05B 17/00; E05B 17/2023; E05B 65/0894
USPC ..... 292/288
See application file for complete search history.

(56) References Cited

U.S. PATENT DOCUMENTS

| | | | | |
|---|---|---|---|---|
| 359,815 | A | 3/1887 | Sargent | |
| 605,809 | A | 6/1898 | Plimpton | |
| 672,473 | A | 4/1901 | Brooks | |
| 1,057,277 | A | 3/1913 | Rogers | |
| 1,073,238 | A | 9/1913 | Huston | |
| 1,477,731 | A | 12/1923 | Ulrich | |
| 1,888,425 | A | 11/1932 | Dowling | |
| 2,288,022 | A | 6/1942 | O'Brien et al. | |
| 2,562,301 | A | 7/1951 | Dorion | |
| 2,588,077 | A * | 3/1952 | Beadle | E05C 19/182 292/295 |
| 3,423,968 | A | 1/1969 | Foote | |

(Continued)

OTHER PUBLICATIONS http://doorbearacade.com/image-gallery, accessed Apr. 4, 2016.

(Continued)

*Primary Examiner* — Nathan Cumar
(74) *Attorney, Agent, or Firm* — AFMCLO/JAZ; Jeffrey Moore

(57) ABSTRACT

A door barricade apparatus includes a blade with a barb at a distal end and a tang at a proximal end. The barb is configured to be disposed within an aperture of a strike plate. A body has a top and a bottom, and the body is operably coupled to the tang of the blade. A paddle is moveably coupled to the body and is configured to selectively move between a first orientation substantially flush with the top of the body and a second orientation protruding from the top of the body. A handle is coupled to the bottom of the body and is configured to keep a user's fingers away from a door jamb. An actuator is in cooperation with the paddle, and is configured to selectively position the paddle between the first orientation and the second orientation.

11 Claims, 3 Drawing Sheets

(56) References Cited

U.S. PATENT DOCUMENTS

| | | | | |
|---|---|---|---|---|
| 3,429,151 | A | 2/1969 | Weingart | |
| 3,589,761 | A | 6/1971 | Lambert | |
| 3,671,067 | A | 6/1972 | Wegner et al. | |
| 3,837,117 | A * | 9/1974 | Butt | E05B 65/0017 49/18 |
| 3,854,764 | A | 12/1974 | Corrigan | |
| 3,913,962 | A | 10/1975 | Briggs | |
| 4,022,503 | A | 5/1977 | Bey | |
| 4,082,335 | A | 4/1978 | Smith | |
| 4,169,619 | A | 10/1979 | McCraken | |
| 4,198,088 | A | 4/1980 | Tochihara | |
| 4,200,317 | A | 4/1980 | Polselli et al. | |
| 4,285,535 | A | 8/1981 | Leary | |
| 4,290,635 | A | 9/1981 | McKenzie | |
| 4,330,146 | A | 5/1982 | Sessions, Jr. | |
| 4,387,919 | A | 7/1983 | Quaintance et al. | |
| 4,406,488 | A | 9/1983 | Polselli et al. | |
| 4,429,913 | A | 2/1984 | Bey | |
| 4,653,786 | A | 3/1987 | Bopst, III | |
| 4,878,701 | A | 11/1989 | Rondel et al. | |
| 4,958,868 | A | 9/1990 | Watrous, Jr. | |
| 5,098,142 | A | 3/1992 | Fontenot | |
| 5,135,272 | A | 9/1992 | Centofante | |
| 5,193,867 | A | 3/1993 | Rusted | |
| 5,203,187 | A | 4/1993 | Kane | |
| 5,221,116 | A | 6/1993 | Lan | |
| 5,265,922 | A | 11/1993 | Falcone | |
| 5,297,829 | A | 3/1994 | Richardson | |
| 5,325,685 | A | 7/1994 | Frank | |
| 5,360,245 | A | 11/1994 | David et al. | |
| 5,462,321 | A | 10/1995 | Osborn | |
| 5,531,491 | A | 7/1996 | Skelton | |
| 5,566,993 | A | 10/1996 | Olivas | |
| D376,747 | S | 12/1996 | Jackson | |
| 5,664,814 | A | 9/1997 | Lin | |
| 5,667,262 | A | 9/1997 | Planchon | |
| 5,685,580 | A | 11/1997 | West et al. | |
| 5,794,871 | A | 9/1998 | Willetts | |
| 5,810,404 | A | 9/1998 | Horne et al. | |
| 5,924,751 | A | 7/1999 | Moore | |
| 5,984,387 | A | 11/1999 | Zeller | |
| 6,409,236 | B1 | 6/2002 | Steele | |
| 6,416,089 | B1 | 7/2002 | Williams, Jr. | |
| 6,658,906 | B1 | 12/2003 | Wright | |
| 6,926,316 | B2 * | 8/2005 | Patire | E05C 19/182 292/290 |
| 6,976,716 | B2 | 12/2005 | Lin | |
| 7,216,902 | B2 | 5/2007 | Marra et al. | |
| 7,360,809 | B1 | 4/2008 | Poston | |
| 7,419,197 | B1 | 9/2008 | Leith | |
| 8,469,410 | B2 | 6/2013 | Wood | |
| 8,510,994 | B2 | 8/2013 | Scott | |
| 8,919,896 | B1 * | 12/2014 | Shewchuck | B25H 3/021 16/405 |
| 2002/0178655 | A1 * | 12/2002 | Pedemonte | E05F 15/603 49/339 |
| 2010/0026017 | A1 | 2/2010 | Ramos, III | |

OTHER PUBLICATIONS http://www.bilco.com/foundations/store/storepage.asp?page=products, accessed Apr. 4, 2016.
http://www.door-jammer.com, accessed Apr. 4, 2016.
http://www.wedgeit.com/specifications.html, accessed Apr. 4, 2016.
http://www.addalock.com/shop/add-a-lock, accessed Apr. 4, 2016.
http://howsarlock.com/howsar_lock_features.php, accessed Apr. 4, 2016.
http://www.amazon.com/Secure-Portable-Door-Safety-Lock/dp/B001IZ7RU2, accessed Apr. 4, 2016.
http://www.amazon.com/Brainerd-Portable-Door-Lock-Personal/dp/B000I1CKGI, accessed Apr. 4, 2016.

* cited by examiner

INWARD SWINGING DOOR BARRICADE

Pursuant to 37 C.F.R. § 1.78(a)(4), this application claims the benefit of and priority to prior filed Provisional Application Ser. No. 62/181,432, filed 18 Jun. 2015 which is expressly incorporated herein by reference.

RIGHTS OF THE GOVERNMENT

The invention described herein may be manufactured and used by or for the Government of the United States for all governmental purposes without the payment of any royalty.

FIELD OF THE INVENTION

The present invention relates generally to fenestration security products and, more particularly, to rapidly deployable door barricade devices.

BACKGROUND OF THE INVENTION

Many facilities are configured with interior rooms, closets, passageways, and the like, that were not designed to serve as an impediment to reasonably dedicated forced entry. While there are instances where it is desirable to expediently secure areas not usually intended for shelter, hardware and infrastructure configurations may render attempts difficult or impossible.

At one extreme, passage function locksets are installed in certain areas of such facilities. A passage locket may be defined as a cylindrical or mortise locksets wherein neither the interior, nor exterior, knob or lever is capable of being locked against rotation (nor otherwise mechanically disengaged from the latch as is possible with lost-motion, or free-wheeling, type of vandal resistant door hardware). Passage lockets, while readily available in robust and heavy-duty Grade 1 cylindrical or mortise configurations, are often installed in locations that building designers deem security or privacy to be superfluous. Passage locksets are generally less expensive, but avoidance of nuisance locking events may also influence one's decision to use passages sets. Passage sets may be found on closet doors, doors leading from upper floors to stairwells, doors located in a cluster beyond a common locked entryway, and the like.

In areas where the prevention of unintentional entry by a well-intentioned individual is important, a privacy function lockset may be used. A privacy function lockset may be defined as a lockset wherein the exterior knob or lever may be locked against rotation by way of a thumb turn, push-button, or similar non-keyed action by a user standing on the interior side. In most instances, the exterior privacy knob or lever does not employ a keyed cylinder as a means for unlocking the lockset (say, in the event that a patient become incapacitated while in a bathroom). Rather, a manufacturer provided tool (e.g., a polygonal rod, an implement analogous to a small blade screwdriver, etc.), or a feature capable of being interfaced with a household item (e.g. a slot that may be twisted with a coin), may be used to unlock the door. As such, only someone who desires to honor the wishes of the occupant's privacy is prevented from opening the door. "Defeat" of the privacy function lock is trivial for an individual who wishes to enter the locked door.

Facilities may also employ keyed lockets in multiple configurations. However, even though keyed, the function or construction of the lockset may not contemplate delaying a determined forced entry attempt. For example, the lockset on a CEO's door may be keyed differently from other employee's doors, but may be no more resistant to forced entry (by kicking, wedging, prying, etc.) than the privacy function locksets used in the same facility. Additionally, most locksets are not designed with a feature that will repel a nefarious possessor of the correct key. For example, the CEO may leave his keys on a secretary's desk, while simultaneously desiring to lock himself in his office during a workplace violence event. Similarly, in some buildings, electronic key card access causes many doors to be "locked" to general access, but may be unlocked with an electronic key card possessed by employees or staff.

As a result of these limitations, a number of ingress denial, or ingress delay, apparatus and methods have been devised to combat the perceived threat of active shooters, workplace violence, or other forced entry into an occupied room. Barricading during these events with furniture, desks, bookshelves, etc. is recommended (for example, by the U.S. Department of Homeland Security) but takes time, effort, and may not be possible or effective. For example, an individual of slight build, or a child, may be unable to position massive furniture components for use as a barricade. Additionally, an outswinging door is less conducive to barricading with furniture, since the door swings free of the impeding furniture mass.

Likewise, replacement locksets having dedicated lockout features do exist, but upgrading facility locks is often cost prohibitive. For example, to replace a single classroom function lockset with an "intruder function" lockset may cost $500 to $700 in the case of a grade 1 mortise lockset.

Similarly, auxiliary devices exist that are configured to bolster the security of existing door and lockset combinations, however, most are not designed for rapid deployment under the stress of a life threatening encounter. For example, devices marketed to augment hotel locks and disable entry by a maid or emergency key, require a multi-step locking process, and may be multi-part assemblies. Additionally, many have infirmities from a user interface perspective (they are cumbersome to use and the user's fingers/hands/arms can get in the way of the door shutting). Further still, many products are not strong enough to stop a serious effort by a strong intruder to breach the door. Lastly, of the commercially available products that address some of those issues, their robustness may impair removal and egress in the event of an emergency or intervening circumstances.

As a result, there exists a need in the art for a portable, rapidly deployable, emergency door barricade that is sufficiently resistant to forced entry and is designed to facilitate efficient removal thereof.

SUMMARY OF THE INVENTION

The present invention overcomes the foregoing problems and other shortcomings, drawbacks, and challenges of existing door barricade devices. While the invention will be described in connection with certain embodiments, it will be understood that the invention is not limited to these embodiments. To the contrary, this invention includes all alternatives, modifications, and equivalents as may be included within the spirit and scope of the present invention.

According to one embodiment of the present invention a door barricade apparatus is provided. The apparatus includes a blade having a barb at a distal end and a tang at a proximal end. The barb is configured to be disposed within an aperture of a strike plate. A body has a top and a bottom, and the body is operably coupled to the tang of the blade. A paddle is moveably coupled to the body and is configured to selectively move between a first orientation substantially flush with the top of the body and a second orientation protruding from the top of the body. A handle is coupled to the bottom of the body and is configured to keep a user's fingers away from a door jamb. An actuator is in cooperation with the paddle, and is configured to selectively position the paddle between the first orientation and the second orientation.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

DETAILED DESCRIPTION OF THE INVENTION

For the sake of clarity in the discussion that follows, the terms "secure side" or "attack side" may be equated with "exterior" and "occupant side" shall be equated with "interior."

Figure 1:
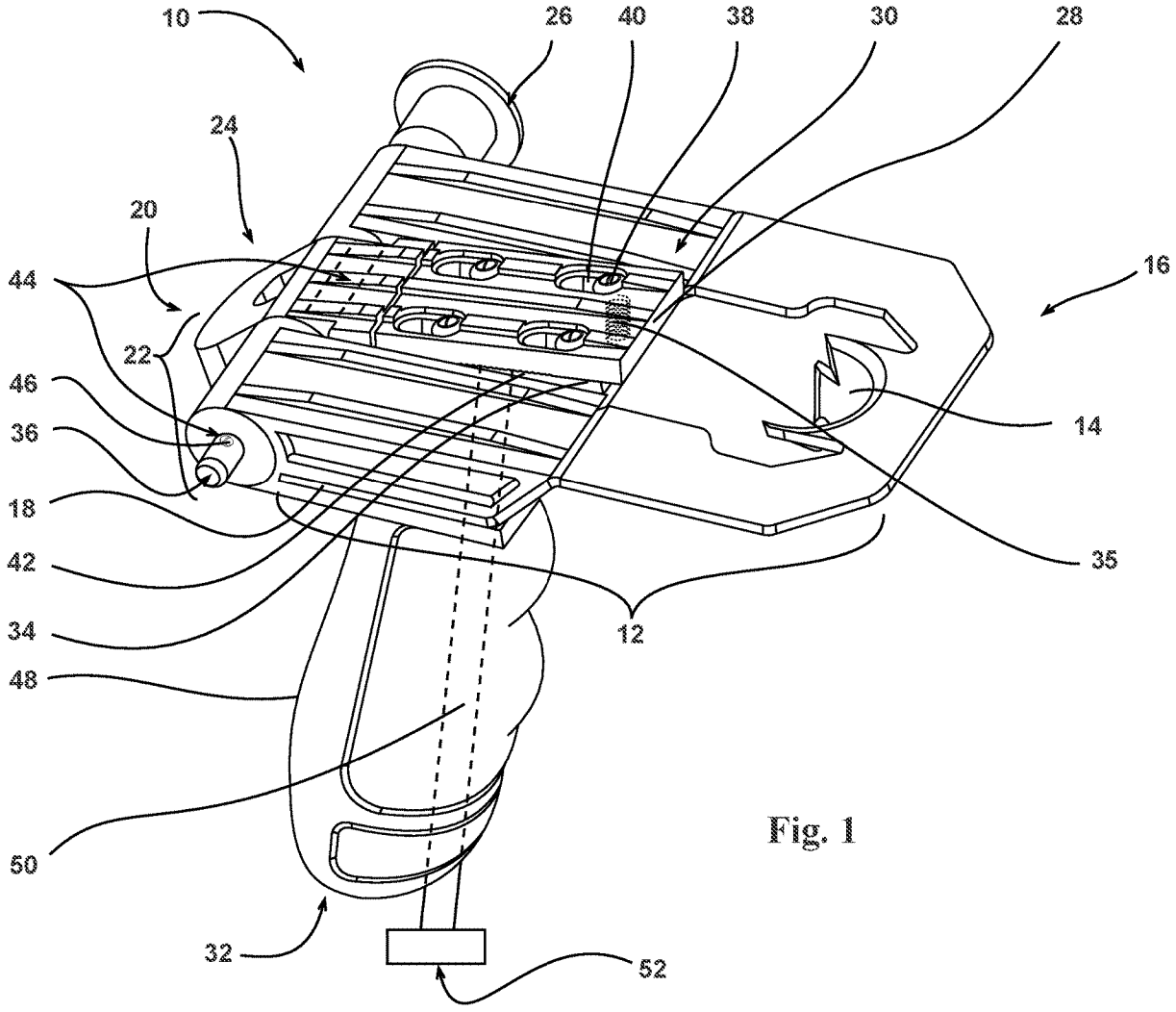
FIG. 1 is a perspective view of an embodiment of the disclosed invention.

Turning attention to FIG. 1, an embodiment of the disclosed inswinging door barricade apparatus 10 is shown. A blade 12 is configured with a barb 14 proximate a distal end 16 and with a tang 18 proximate a proximal end 20. In some embodiments of the disclosed invention, the barb 14 may be integral to the blade 12 by way of stamping, swaging, displacing, or otherwise manipulating the material of the blade 12 so as to depart from the general plane thereof. In other embodiments, the barb 14 may comprise a pin, bolt, rivet, or other protuberance that is affixed substantially perpendicular to the plane of the blade 12. Whether the barb 14 is established by additive means or is integral to the blade 12, it may include features know by one of ordinary skill in the art to enhance the resistance to shear forces applied thereto. By way of example, and not limitation, the barb 14 may include conical or cylindrical features, fillet or ribbed reinforcements, a mounting angle inclined toward the applied shear force, or the like.

At least a portion of a tang 18 is subsumed by a body 22. The portion of the tang 18 may be secured to the body 22 by way of mechanical fasteners, overmolding the body 22 around the tang 18, adhesives, or other means known to one of ordinary skill in the art. The body 22 includes an actuator 24, an egress feature 26, and a paddle 28. The actuator 24 is operably coupled to the paddle 28 and is configured to be engaged by the finger or thumb of a user. In some embodiments, the centerline plane of the actuator 24 may be substantially coplanar with the top 30 of the apparatus 10. In other embodiments, and as depicted in FIG. 1, the actuator 24 may be angled downwardly towards the bottom 32 of the apparatus 10. As will be described in greater detail below, a user may realize advantages from the depicted downwardly deflected actuator 24, when the apparatus 10 is put into use.

In some embodiments, the actuator 24 may be operably coupled to the paddle 28 by way of an actuator extension 34. The actuator 24 and cooperating actuator extension 34 may rotate about a centerline of a shaft 36. The travel, or degree of rotation permitted to the actuator 24 and cooperating actuator extension 34 may be limited by means known to one of ordinary skill in the art. Additionally the actuator 24, or actuator extension 34 may be biased in one rotational direction. That is, a spring or other resilient member 35 may be applied to either the actuator 24, the actuator extension 34, or to the paddle 28, to bias the paddle 28 away from the top 30 of the apparatus 10. As a result, in some embodiments, the apparatus 10 may secure a door merely by pushing the door shut on the emplaced apparatus 10, thus allowing the door to temporarily deflect the paddle 28. The paddle 28 thereafter returns to its projected position automatically by way of the resilient member 35. To remove the apparatus 10, a user may then apply a force upon the actuator 24 in a direction from the bottom 32 to the top 30 of the apparatus 10. Such a force, if sufficient to overcome the bias and other forces applied to the apparatus 10 will align the paddle 28 substantially coplanar (or flush) with the top 30 of the apparatus 10. In some embodiments, the paddle 28 may pivot about an axis of rotation (as depicted in FIG. 1 by way of the shaft 36), or, in other embodiments, the paddle 28 may reciprocate axially between flush and protruding configurations (as a protruding pin, peg, or other projection).

In other embodiments, structures intervening between the actuator 24 and the paddle 28 may reverse the direction of paddle 28 travel in response to a force applied by a user. For example, in some embodiments, gears, levers, eccentric surfaces, or the like may allow a user to apply a force to the actuator 24 in a direction from the top 30 to the bottom 32 of the apparatus 10, that results in the paddle 28 becoming substantially coplanar with the top 30 of the apparatus.

In some embodiments of the disclosed invention, the spatial relationship between the center of mass of the paddle 28, with respect to the distal end 16 of the blade 12 (and by extension with respect to the barb 14) may be adjusted. For example, clamping fasteners 38 may be disposed within eccentric channels 40. Loosening of the clamping fasteners 38 may permit the paddle 28 to reciprocate with respect to the actuator extension 34 and within the positional limits established between the interface of the clamping fasteners 38 and the eccentric channels 40. Tightening the clamping fasteners 38 thereafter fixes the spatial relationship between the paddle 28 and the distal end 16 of the blade 12.

In some embodiments, indexing features 42 may be included on the paddle 28 and the actuator extension 34. The indexing features 42 of the paddle 28 and the indexing features 42 of the actuator extension 34 are configured to mate in a tight fitting relationship. The indexing features 42 may include, by way of example and not limitation, grooves, channels, stippling, splines, projections and bores, or other features known by one of ordinary skill in the art to index the relationship of the paddle 28 with respect to the actuator extension 34 as discrete increments. Embodiments of the disclosed invention comprising indexing features 42 yield enhanced resistance to displacement of the spatial relationship of the paddle 28, as compared to relying solely upon frictional forces established between the paddle 28, actuator extension 34, and clamping fasteners 38. Additionally, in some embodiments, the angle established between the projected paddle 28 and the top 30 may be adjusted by a user. For example a projected angle between the paddle 28 and the top 30 of 5 degrees may be sufficient to provide secure locking action on most doors, but a projected angle of 10-20 degrees may be required to secure doors with large gaps (margin 80, FIG. 3) between the door and jamb or frame. In embodiments that utilize a reciprocating pin in lieu of the pivoting paddle 28, the distance of the pin's projection may be analogously adjusted to achieve a greater projection from the top 30.

Figure 2:
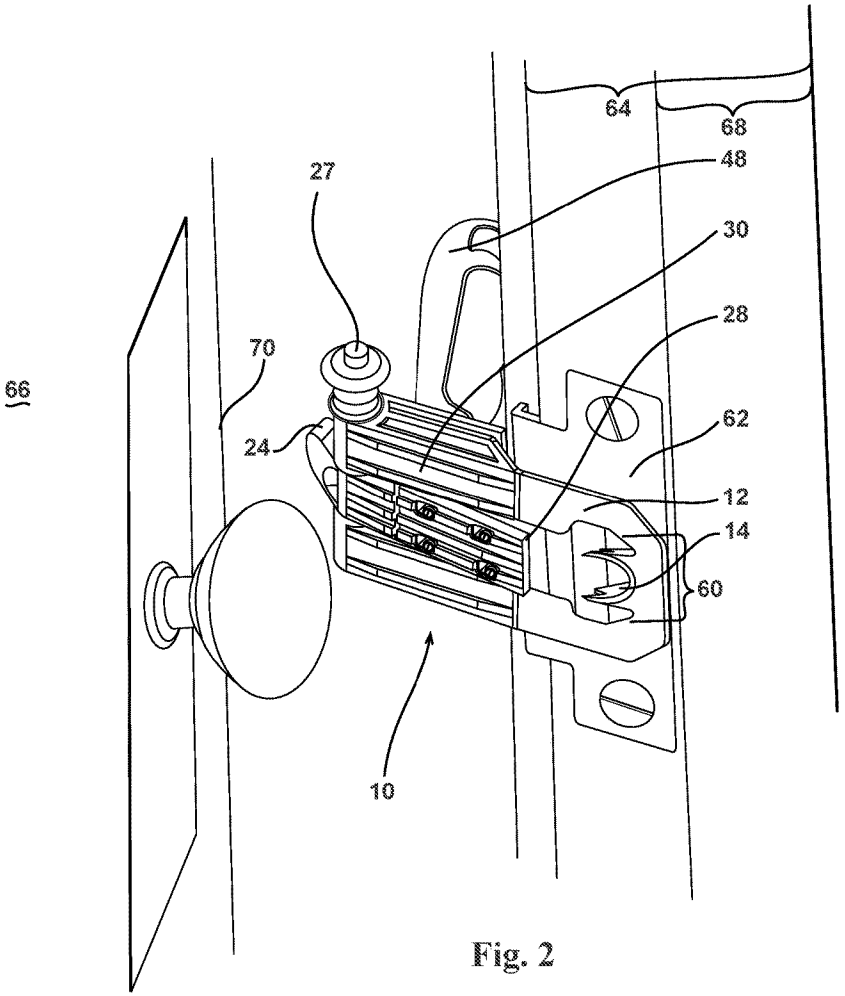
FIG. 2 illustrates an embodiment of the disclosed invention emplaced within the aperture of a strike plate of a door jamb.
Figure 3:
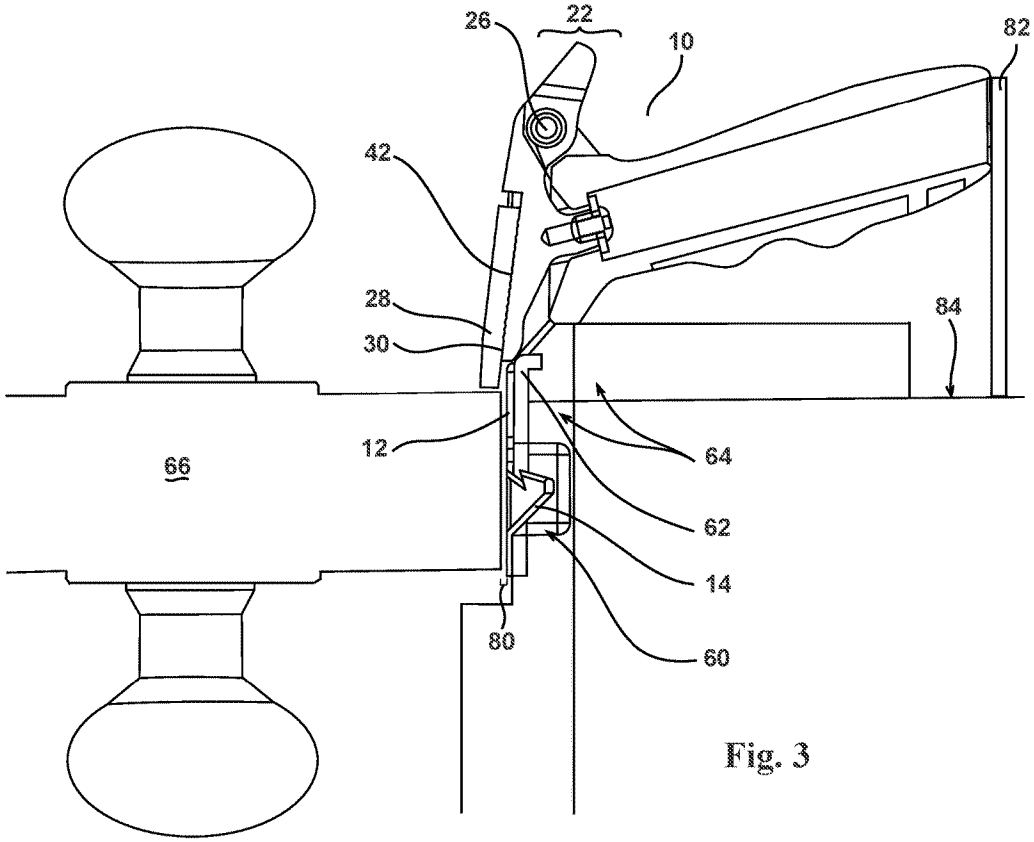
FIG. 3 is a top view partial cut-away view of an embodiment of the disclosed invention, in use, securing a door in the closed position It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

The egress feature 26, as depicted in FIG. 1 is established by way of a modification to the shaft 36. In normal use, as will be explained in detail below, the shaft 36 serves as a pivot point for the actuator 24. The paddle 28 in conjunction with its cooperating actuator extension 34 and actuator 24 serve to interfere with the movement of a door (FIGS. 2-3).

When attached to a door, manipulation of the actuator 24 is the primary means to in turn retract the paddle 28 by making the paddle 28 substantially co-planer with the top 30 of the apparatus 10. However if one wishes to disable the interference of the paddle 28 upon the door by alternate means, the egress feature 26 may be employed. In some embodiments, the egress feature 26 shaft 36 is retained within its cooperating bores 44 by way of a spring loaded detent ball 46. The detent ball 46 interferes with withdraw of the shaft 36 from the bores 44, but such interference may be overcome by applying sufficient axial force to the shaft 36 (sufficient force to force the detent balls 46, flush with the shaft 36 and bores 44). Upon removing the egress feature 26 shaft 36 from the bores 44, the paddle 28, will fall free of the body 22. In some embodiments, the actuator 24 and actuator extension 34 will fall free of the body 22. In both embodiments, the blocking action of the paddle 28, with respect to the door, is defeated. The egress feature 26 serves as a redundant means of egress (in addition to manipulating the actuator 24), and may be used by those with impaired manual dexterity, or may serve as a more reliable means of egress by a child or elderly user. It will be understood by one of ordinary skill in the art that a deadlocking ball detent may be substituted for use in lieu of the spring loaded ball detent 46 to meet design objectives. A deadlocking ball detent is one that requires an additional user manipulation (pushing a button 27, turning a knob, etc.) before the retaining effect of the detent may be defeated.

The egress feature 26 need not be limited to removal of the shaft 36. In some embodiments, a lever, removable pin, or cam, may be configured to de-couple the paddle 28 from the actuator extension 34 or body 22. In other embodiments, a cable or rod 50 (shown as hidden element 50) coupled to the paddle 28 may terminate at a t-handle 52 or other easy to grasp feature. Appling an axial force to the t-handle 52 will serve to bring the paddle 28 substantially flush with the top 30 of the apparatus 10. In other embodiments, a torque applied to the handle 48 or t-handle 52, may utilize coarse threads or cam surfaces to displace the cable or rod 50 and bring the paddle 28 substantially flush with the top 30 of the apparatus 10.

The handle 48, is coupled to the body 22 in an orientation selected to protect a user's hands from being crushed between a closing door and the door jamb. When emplacing the apparatus 10 during an emergency situation, the large handle 48 provides sufficient purchase even while a user's fine motor skills are diminished. For example, some handles 48 are configured such that a user may grasp the handle 48 similar to a broom handle 48 in his fist. Additionally, the actuator 24, may be declined at a downward angle (sloping from the top 30 to the bottom 32 of the body 22), so that the apparatus 10 is guided into proper alignment (even if sub-optimally placed with respect to the door and the door frame), by the slamming door.

The following examples illustrate particular properties and advantages of some of the embodiments of the present invention. Furthermore, these are examples of reduction to practice of the present invention and confirmation that the principles described in the present invention are therefore valid but should not be construed as in any way limiting the scope of the invention.

Turning attention to FIG. 2, in use, the barb 14 of the blade 12 is placed within the aperture 60 of the strike plate 62 affixed to the jamb 64. As shown in FIG. 2, the paddle 28 is depicted in the protruding orientation or configuration (not co-planer with the top 30 of the apparatus 10). The apparatus 10 is held against the jamb 64 by use of the handle 48 by the hand of a user. In doing so, the hand of the user is kept free from being crushed by the closing door 66. The door 66 can then be pushed shut against the rabbet 68 of the jamb 64. The pushing of the door 66 overcomes the spring bias of the paddle 28, temporarily displacing it into a substantially co-planer relationship with the top 30 (or, displacing the paddle 28 to sufficiently clear the edge 70 of the door 66). Alternatively, to deploy the apparatus 10 more silently, a user could manipulate the actuator 24, so as to withdraw the paddle 28 out of contact with the edge 70, prior to gently closing the door 66. Once the door 66 has cleared the paddle 28 and seated against the rabbet 68, and the user has released the actuator 24, the spring bias of the paddle 28 will cause the paddle 28 to rebound to its original position (the position as shown in FIG. 2).

Turning attention to FIG. 3, the apparatus 10 is shown trapped within the margin 80 of the door 66 and jamb 64 by way of the interference of the barb 14 (not visible in this figure) disposed within the aperture 60 of the strike plate 62. The paddle 28 prevents the door 66 from being opened until such time as the paddle 28 is withdrawn flush and co-planer with the top 30 of the apparatus 10, the egress feature 26 is activated, or forces applied to the door 66 and apparatus 10 result in mechanical failure.

Some embodiments of the disclosed invention may include a torque (or moment) limiter 82 that extends from some portion of the apparatus 10 into contact (or near contact) with a wall 84. As will be recognized by one of ordinary skill in the art, when the apparatus 10 is in place on a closed door 66, an attempt to open the door 66 imparts a force upon the paddle 28. The force experienced by the paddle 28 is predominantly a shear force, but that shear force is further translated to the body 22 and barb 14. Since the barb 14 is trapped within the aperture 60, the body 22 absorbs the force of the opening door 66 as a torque that will tend to (if viewed as depicted in FIG. 3) rotate the body 22 in a clockwise direction. Under extreme force, the body 22 may be sufficiently rotated, such that the paddle 28 no longer interferes with the opening of the door 66. To counteract this torque, the torque limiter 82 provides a counteracting torque (by pushing off of the wall 84), thus substantially raising the force required to cause the apparatus 10 to fail. As discussed herein "wall" may be understood to be any robust surface adjacent the door 66, to include drywall, masonry, wood or metal casing or framing, or the like. With the torque limiter 82 in place, an applied force would need to be sufficient to shear off the barb 14, shear off the paddle 28, cause tensile failure of the blade 12, or failure of some other interconnecting components.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A door barricade apparatus, the apparatus comprising:

a blade including a barb at a distal end and a tang at a proximal end, wherein the barb is configured to be disposed within an aperture of a strike plate;

a body having a top and a bottom, wherein the body is operably coupled to the tang of the blade;

a paddle moveably coupled to the body and configured to selectively move between a first orientation substantially flush with the top of the body and a second orientation protruding from the top of the body;

a handle coupled to the bottom of the body and configured to keep a user's fingers away from a door jamb; and an actuator in cooperation with the paddle; and configured to selectively position the paddle between the first orientation and the second orientation, further including a resilient member, wherein the resilient member is configured to bias the paddle to the second orientation, and wherein the paddle will automatically return to the second orientation after being temporarily displaced to the first orientation.

2. The apparatus of claim 1, further including an actuator extension coupled between the actuator and the paddle; wherein the actuator extension is configured to adjust the spatial relationship between the paddle and the barb.

3. The apparatus of claim 2, wherein mating surfaces of the actuator extension and the paddle include indexing features.

4. The apparatus of claim 1, further including an egress feature configured to provide an auxiliary means of removing the apparatus when the apparatus is coupled to a door and door frame.

5. The apparatus of claim 4, wherein the egress feature is configured to manipulate the paddle into the first position independent from manipulation of the actuator.

6. The apparatus of claim 4 wherein the egress feature includes a removable shaft configured to decouple the paddle from the body upon withdrawal of the removable shaft.

7. The apparatus of claim 6, further including a spring detent configured to retain the removable shaft against unintentional withdrawal from the body.

8. The apparatus of claim 7, further including a deadlocking ball detent configured to require an additional manipulation by a user prior to withdrawing the removable shaft from the body.

9. The apparatus of claim 1, further including a handle configured to be received by the entirety of a user's hand, and further configured to protect the user's hand from being crushed between a door and a door jamb during placement of the apparatus therebetween.

10. The apparatus of claim 1, further including a torque limiter configured to extend from the apparatus into contact or near contact with a wall adjacent the door.

11. The apparatus of claim 1, wherein an angle established between the paddle and the top of the body, while the paddle disposed in the second orientation, is configured to be adjustable.

* * * * *